US006720856B1

(12) United States Patent
Pellon et al.

(10) Patent No.: US 6,720,856 B1
(45) Date of Patent: Apr. 13, 2004

(54) CALIBRATION STRUCTURE FOR CIRCUIT BREAKERS HAVING BIMETALLIC TRIP MEMBER

(75) Inventors: Christian V. Pellon, Norton, MA (US); Nicholas V. Pellon, Norton, MA (US); William J. Bentley, North Attleboro, MA (US); Eric W. Morrison, Woonsocket, RI (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/325,252

(22) Filed: Dec. 18, 2002

(51) Int. Cl.[7] ..... H01H 73/30; H01H 73/22

(52) U.S. Cl. ..... 337/82; 337/84; 337/66; 337/94; 200/286

(58) Field of Search ..... 337/57, 36, 37, 337/66, 67, 85, 94, 333, 334, 362, 360, 82, 84; 200/286, 341

(56) References Cited

U.S. PATENT DOCUMENTS

| | | | | | |
|---|---|---|---|---|---|
| 2,122,693 | A | * | 7/1938 | Maseng | 337/70 |
| 3,361,882 | A | | 1/1968 | Clarke | |
| 3,451,016 | A | * | 6/1969 | Ellenberger | 335/23 |
| 3,697,915 | A | * | 10/1972 | Brassard | 337/74 |
| 3,832,667 | A | * | 8/1974 | Blanton | 337/354 |
| 3,958,197 | A | * | 5/1976 | Gryctko | 335/18 |
| 4,400,677 | A | * | 8/1983 | Cobb et al. | 337/6 |
| 5,781,097 | A | * | 7/1998 | Givler | 337/367 |
| 6,229,426 | B1 | * | 5/2001 | Lavado et al. | 337/57 |
| 6,353,526 | B1 | * | 3/2002 | Pellon | 361/115 |

FOREIGN PATENT DOCUMENTS

| | | | | |
|---|---|---|---|---|
| JP | 2002231117 A | * | 8/2002 | H01H/73/30 |

* cited by examiner

*Primary Examiner*—Anatoly Vortman
(74) *Attorney, Agent, or Firm*—Frederick J. Telecky, Jr.; Rusell E. Baumann

(57) ABSTRACT

A thermally compensated circuit breaker has a movable contact assembly (24) which mounts a movable electrical contact (24*m*) for movement between open and closed contacts positions with a stationary electrical contact (26). The contacts are maintained in the closed circuits position by a latching mechanism (24*b*, 28*g*) which prevents opening of the contacts through an opening contacts force provided by a spring (24*e*). A current carrying trip arm (40*a*, 44*a*) deflects upon sufficient $I^2R$ heating to transfer motion to the latch to separate the latch (24*b*) from the latch receiving catch (28*g*) to trip the circuit breaker. The trip arm (40*a*, 44*a*) is part of a pivotably mounted actuator assembly (40, 44) having a movable end portion spaced from the pivot disposed adjacent a motion transfer member (28*c*). A calibration screw (42*a*) is located so that the longitudinal axis is in line with a movable end portion of the actuator assembly and the motion transfer member. In one embodiment the head of the calibration screw is captured in a slot in the free end of a calibration base (42*d*) attached to the trip arm so that deflection of the trip arm directly transfers motion to the motion transfer member and in another embodiment the calibration screw head is captured in a slot in the free end of the trip arm so that a bowing deflection of the trip arm causes a calibration base (46) to which it is attached at an end thereof to rotate with the calibration base directly transferring motion to the motion transfer member.

12 Claims, 5 Drawing Sheets

CALIBRATION STRUCTURE FOR CIRCUIT BREAKERS HAVING BIMETALLIC TRIP MEMBER

FIELD OF THE INVENTION

This invention relates generally to thermostatic type circuit breakers used to interrupt an electrical circuit under selected overload conditions and more particularly to improvements in means for calibrating such circuit breakers.

BACKGROUND OF THE INVENTION

Trip free, ambient compensated circuit breakers are well known. An example of this type of circuit breaker is disclosed and claimed in U.S. Pat. No. 3,361,882, assigned to the assignee of the present invention, the subject matter of which is incorporated herein by this reference. As described, the circuit breaker of this type has a movable contact assembly mounting a movable electrical contact for movement between open and closed contact positions with a stationary electrical contact. A latching mechanism is provided for maintaining the movable electrical contact in the closed contacts position against the bias of a contacts opening spring. An overload trip assembly includes a thermostatic actuator in the form of an elongated, U-shaped bimetallic member having at one end the free ends of two legs fixedly mounted to a supporting member in the housing of the circuit breaker with the bight or junction of the two legs forming a second end of the bimetallic member. The bimetallic member forms a part of the circuit path through the circuit breaker and with a selected overload, such as current exceeding the rated current value for a certain length of time, the bimetallic member will deflect with the second end thereof transferring motion to a motion transfer plate which in turn moves a latch receiving catch of the latching mechanism away from a latch of the movable contact assembly to thereby enable the contact opening spring to move the movable electrical contact to the open contacts position.

As shown in the referenced patent, the thermostatic actuator is calibrated by means of an adjusting screw threaded through one wall with the end of the screw aligned with a second parallelly extending wall. Sufficient rotation of the screw will bend the second wall moving it against the elongated bimetallic member adjacent the first end to thereby move the second end of the bimetallic member toward an ambient compensation assembly which includes the latch receiving catch on the other side of the circuit breaker. Small changes in the position of the calibration screw result in amplified displacements at the top of the second end of the bimetallic member, e.g., approximately 2.5:1, in devices made similar to those shown in the patent. For example, a quarter turn of a #0–80 UNF thread calibration screw moves the second wall approximately 0.003inch which, in turn, moves the top of the second end of the bimetallic member approximately 0.007inch.

During operation, current passes from a load terminal through one leg of the U-shaped bimetallic member and out the other leg through a conductive strap and then to the contacts. The bimetallic member warms up due to $I^2R$ heating and then bends due to the different coefficients of expansion of the bimetal layers. At calibrated current loads and temperatures, the bimetallic member will deflect and push the motion transfer plate the required distance to trip the circuit breaker latch mechanism.

A variation of the calibration mechanism, not shown in the patent but in wide use, is the use of a calibration clip which has one wall which holds the screw and a second spaced apart wall portion which holds the first end,of the bimetallic member. The screw is provided with a head which is nested into the second wall portion of the clip so that if the screw is turned in too far it can then be turned backwards concomitantly with the second wall portion to allow additional calibration attempts. In the previously discussed calibration structure described in the patents, some additional calibration attempts are possible due to spring back of the second wall when the screw is turned out, limited by stress relief and the like. This variation is subject to the same type of amplified motion as in the calibration structure described in the patent.

SUMMARY OF THE INVENTION

It is an object of the invention to provide a calibration assembly which has less sensitivity and one which enables increased performance repeatability. Another object of the invention is the provision of a circuit breaker having a calibration assembly which has improved durability. Another object is the provision of a circuit breaker which overcomes the prior art limitations noted above.

Briefly, in accordance with the invention, the calibration screw for the bimetallic member, also referred to as trip arm hereinafter, is placed in line with the top or second end of the trip arm. This provides one-to-one displacement for the screw to trip arm significantly reducing calibration sensitivity and increasing performance repeatability. According to a first embodiment, the trip arm of the actuator assembly is generally U-shaped with the free ends of the legs forming a first end of the trip arm. The free end of one leg is fixedly connected, as by welding, to a first end of a pivotable calibration base with a piece of insulation material, such as Kapton tape disposed about the free end of the second leg and then received in a clip portion of the calibration base bent back on itself to capture the leg. The calibration base is pivotably mounted in the housing of the circuit breaker and has a slotted second end aligned with and generally coextensive with the second end of the U-shaped trip arm, i.e., the bight or junction of the two legs with the trip arm disposed intermediate the calibration base and the motion transfer member. The calibration screw head is formed with a circumferentially extending groove which receives and captures the slotted end of the second end of the calibration head. Rotation of the calibration screw will cause pivoting movement of the actuator assembly toward or away from the motion transfer plate adjacent thereto.

Upon application of power, current flows through a load terminal to a first pigtail or flexible conductor to a leg of the trip arm and exits the trip arm through a second pigtail and then flows to the contacts. The trip arm heats due to $I^2R$ heating to provide mechanical deflection to trip the circuit breaker upon a selected overload.

In a second embodiment, the trip arm, i.e., the bimetallic member, extends in a straight line and is attached as by being welded to the bottom of a pivotably mounted calibration base which also extends in a straight line and is generally coextensive with the trip arm. In this embodiment the calibration base is disposed intermediate to the trip arm and the motion transfer member with the second end of the trip arm provided with a slot which is received in a circumferentially extending groove in the head of the calibration screw. A wider slot is provided in the second end of the trip member providing clearance for the head of the calibration screw. As in the first embodiment, the calibration screw is positioned in line with the motion transfer member. Thus, rotation of the calibration screw will move the second end of the actuator assembly toward or away from the motion transfer member.

During operation, current flows through a load terminal to a first pigtail and into the first end of the trip arm, then through the length of the trip arm out through a second pigtail to the contacts. With both ends of the trip arm supported, the trip arm bows as it becomes heated due to the different coefficients of expansion of the thermostatic layers. Since the trip arm and base are permanently attached near the bottom pivot location at the first end of the assembly, the second end of the calibration base rotates toward the motion transfer member with the change in slope of the bowing trip arm.

Other objects, features and advantages of the present invention will appear from the following detailed description of preferred embodiments taken together with the accompanying drawings.

DETAILED DESCRIPTION OF THE PREFERRED EMBODIMENTS

Figure 1:
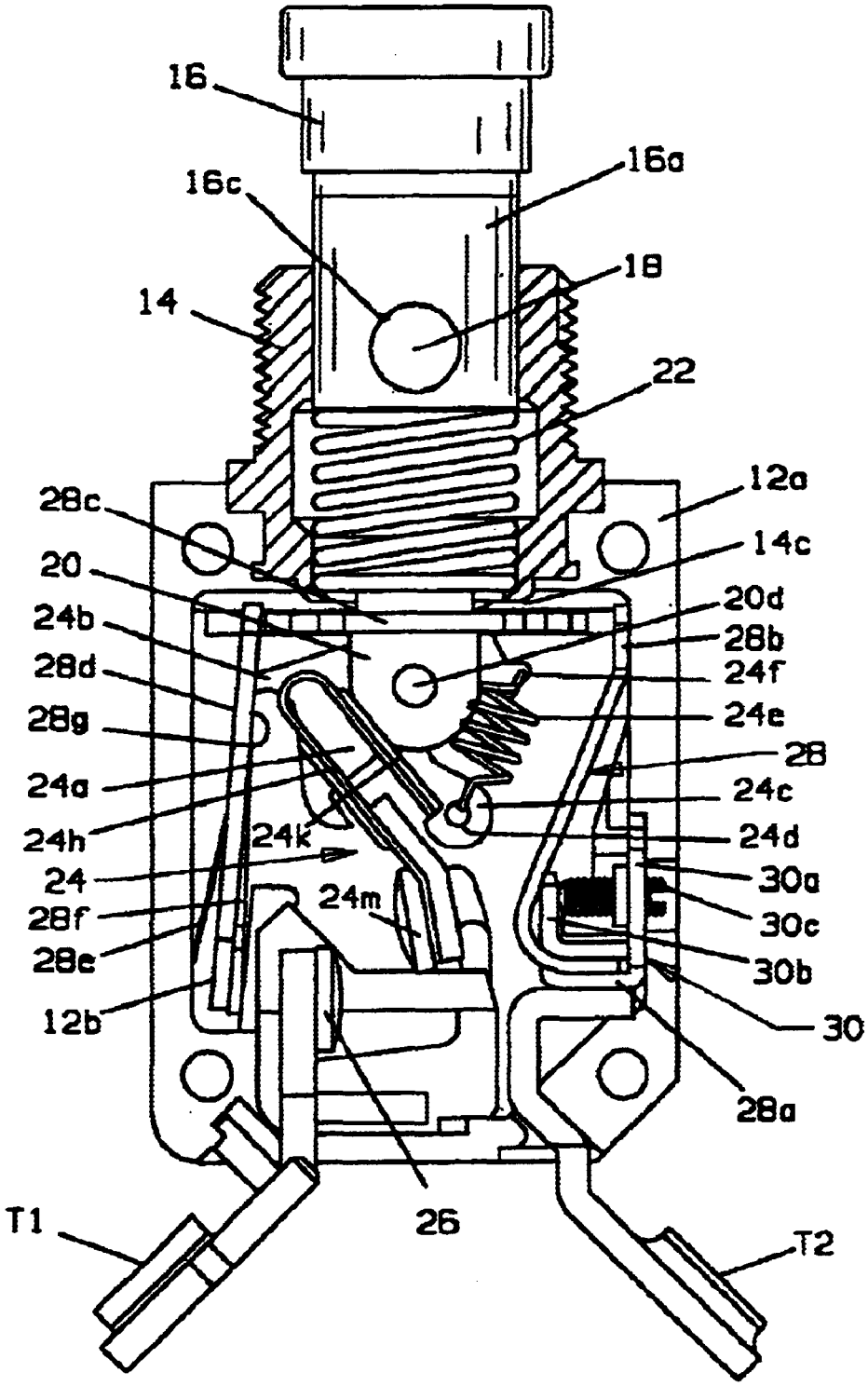
(PRIOR ART) FIG. 1
FIGS. 1 and 2 show cross sectional, front elevational views of a thermally compensated circuit breaker made in accordance with the prior art in the open and closed contacts position, respectively.
Figure 2:
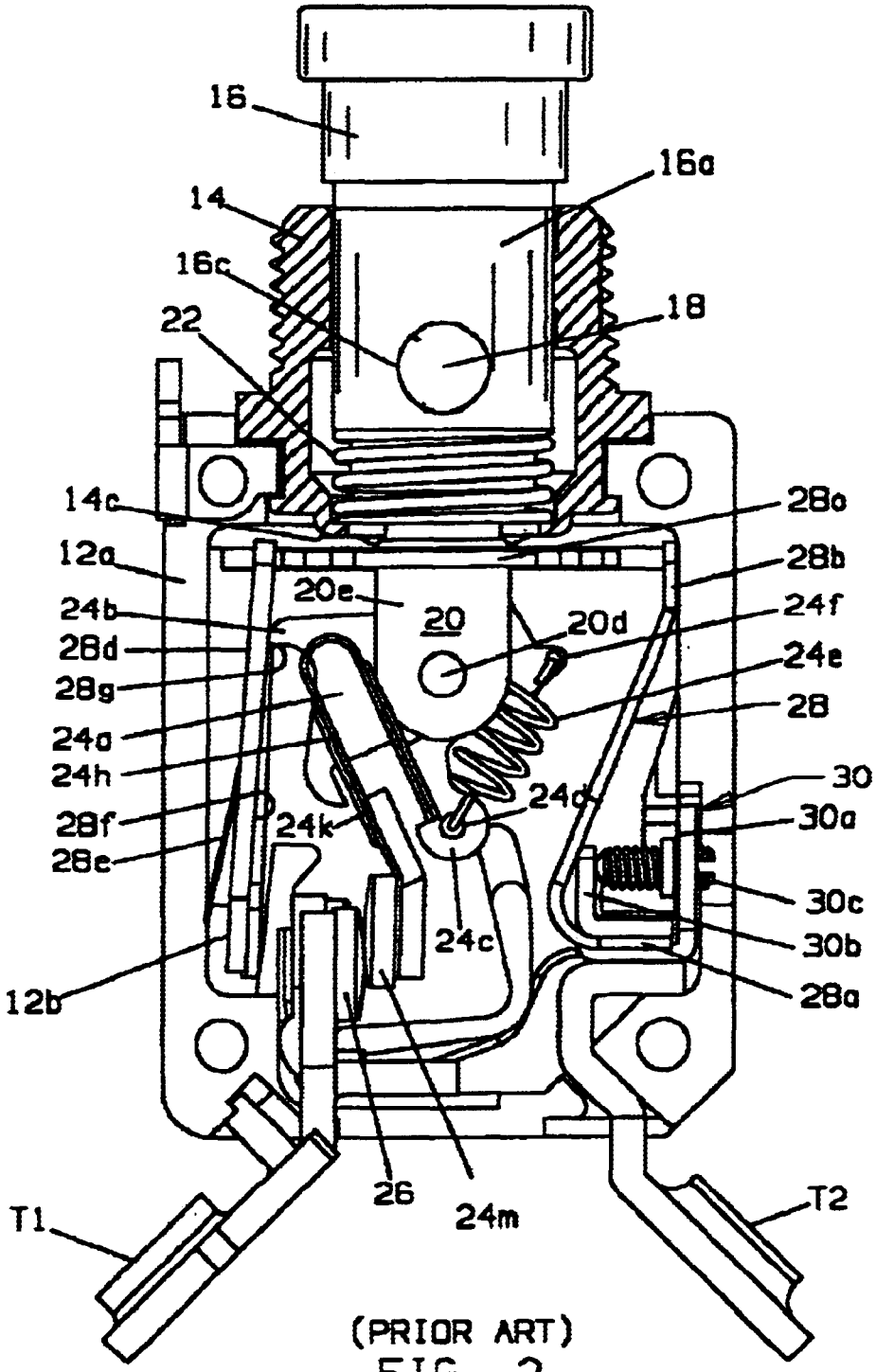
(PRIOR ART) FIG. 2

Turning to FIGS. 1 and 2 of the drawings, a circuit breaker of the type shown and described in U.S. Pat. No. 3,361, 882referenced above, comprises a housing 12 having first and second case halves 12*a*, one being removed in the drawings for purposes of illustration, a mounting bushing 14, a pushbutton 16 slidably movable within the bore of bushing 14 between an open contacts position in which the top of the pushbutton extends outwardly beyond the open end of bushing 14 exposing a color coded cylindrical surface 16*a* providing visual indication of the open contacts position shown in FIG. 1 and a closed contacts position in which cylindrical surface 16*a* is disposed within bushing 14 as shown in FIG. 2.

Pushbutton 16 comprises a barrel portion having openings 16*c* in the wall thereof which receive latching balls 18. A plunger 20 is slidably received in the bore of barrel portion 16*b* and is provided with a circumferentially extending recess (not shown) having circumferentially extending angled biasing surfaces.

A radially extending flange 16*d* is provided on barrel portion 16*b* and a coil button return spring 22 is received between flange 16*d* and a corresponding flange 14*c* formed on the bottom of bushing 14.

Plunger 20 is bifurcated at its lower end as seen in the drawings mounting a pin 20*d* between parallel extending, spaced apart, legs 20*e*, one of which is shown in FIGS. 1 and 2.

A movable contact assembly 24 is rotatably mounted on pin 20*d* and comprises a bell crank plate 24*a* having a latch portion 24*b* and angularly spaced therefrom a leg 24*c* formed with a spring receiving aperture 24*d*. A coil spring 24*e* has an end connected through aperture 24*d* and an opposite end connected through an aperture 24*f* of an anchor plate 24*g* fixedly mounted on plunger 20. Thus, spring 24*e* provides a counterclockwise force on leg 24*c* as seen in FIGS. 1, 2. A contact spring 24*h* is bent back on itself and has one end 24*k* mounted on leg 24*c* and an opposite end which mounts a movable electrical contact 24*m*. The movable electrical contact is mounted for movement between open and closed contact positions with a stationary contact 26 mounted on line terminal T1.

An actuator in the form of a current responsive trip arm 28 has a first end 28*a* mounted on a calibration base 30. Trip arm 28 is a generally U-shaped bimetallic member having two legs, only one leg being shown in the drawing. The free end of one leg is welded to the calibration base which in turn is mounted on and electrically connected to load terminal T2. The free end of the other bimetal leg is electrically isolated from the calibration base but is fixedly mounted and electrically connected to a conductive member such as a strap which extends to a stationary contact (not shown) mounted in the circuit breaker housing but generally aligned with but spaced from stationary contact 26.

During operation in the contacts closed position, current flows from load terminal T2 through the U-shaped bimetallic member or trip arm 28 to the stationary contact isolated from terminal T1 to movable contact 24*m*, a bridging electrical contact between both stationary electrical contacts to electrical contact 26 and terminal T1.

Referring back to the U-shaped bimetallic member 28, the junction of the two legs or bight portion is located at the second end 28*b* of member 28 and is disposed at one side of the circuit breaker adjacent to a motion transfer member 28*c*. Motion transfer member 28*c* is a generally rectangular, window shaped member, having a plunger receiving opening and having tabs (not shown) extending from the front and back of the member, relative to the position shown in the drawings, which are received in laterally extending grooves formed in the case halves of the housing to permit the member to slide to the right and left as shown in FIGS. 1, 2.

An ambient temperature compensation member 28*d* is formed of thermostatic material and has one end received in a recess 12*b* formed in the circuit breaker housing at a side of the housing opposite to the location of trip arm 28. Ambient temperature compensation member 28*d* is provided with a spring 28*e* which urges member 28*d* in a clockwise direction, as seen in FIGS. 1, 2, toward the center of the housing. A latch engaging catch 28*f* having a catch surface 28*g* is fixedly attached to compensation member 28*d* at the base thereof but is otherwise spaced from compensation member 28*d*. That is, a change in temperature will cause essentially the same deflection of the upper or second ends of the trip arm 28*b* and compensation member 28*d* without changing the position of catch surface 28*g*. However, a sufficient increase in temperature of trip arm 28 due to $I^2R$ heating will cause second end 28*b* to deflect toward the center of the housing transferring motion through motion transfer member 28*c*thereby moving compensation member 28*d* which also moves catch 28*f* and catch surface 28*g* away from latch 24*b*. When latch 24*b* is free of catch surface 28*g*, the contacts opening force of spring 24*e* can then move movable contact 24*m* to the open contacts position.

Referring back to trip member 28, calibration base 30 has first and second generally parallel extending wall portions 30*a*, 30*b*. A threaded bore is formed in wall portion 30*a* which receives calibration screw 30*c* which has a distal end engageable with wall portion 30*b*. In calibrating the trip arm, calibration screw is turned to apply a bending force to wall portion 30*b* which in turn transfers motion to trip arm 28.

Further details of the operation of the circuit breaker can be obtained by referring to U.S. Pat. No. 3,361,882, referenced above.

Figure 3:
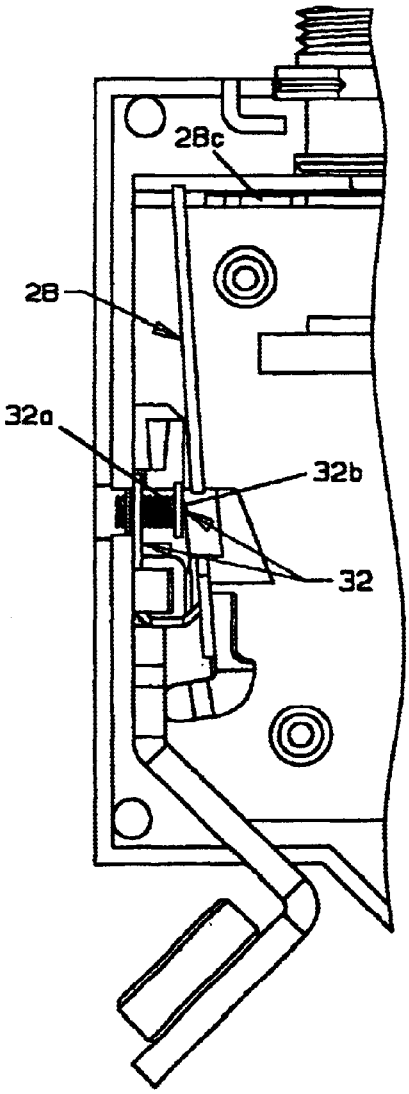
(PRIOR ART) FIG. 3
FIG. 3 is a rear elevational view of the actuator and calibration assemblies of another prior art circuit breaker.

A similar prior art calibration arrangement is shown in FIG. 3 which shows a calibration clip 32 which holds calibration screw 32*a* and trip arm 28. Calibration screw has a head portion 32*b* which is nested into a pocket in clip 32 so that the trip arm can be reversed calibrated. That is, if the screw is turned in too far during calibration, the screw can be turned backwards to allow additional calibration attempts. In the FIGS. 1, 2 structure, additional calibration can also be attempted utilizing spring back of the calibration wall portion upon turning the screw back away from the wall portion. It will be understood that the effectiveness of further calibration attempts is limited by plastic deformation or stress relief which reduces the overall spring back distance.

In both the FIGS. 1, 2 and FIG. 3 structure, displacement of the calibration screw creates an amplified displacement at the second end of the trip arm. In devices made in accordance with the patent, the displacement is amplified by a ratio of approximately 2.5:1making the circuit breaker very sensitive in calibrating. For example, a quarter turn of a typical calibration screw (#0–80 UNF thread) moves the base wall portion approximately 0.003inch which, in turn, moves second end of the trip arm approximately 0.007inch.

Figure 4:
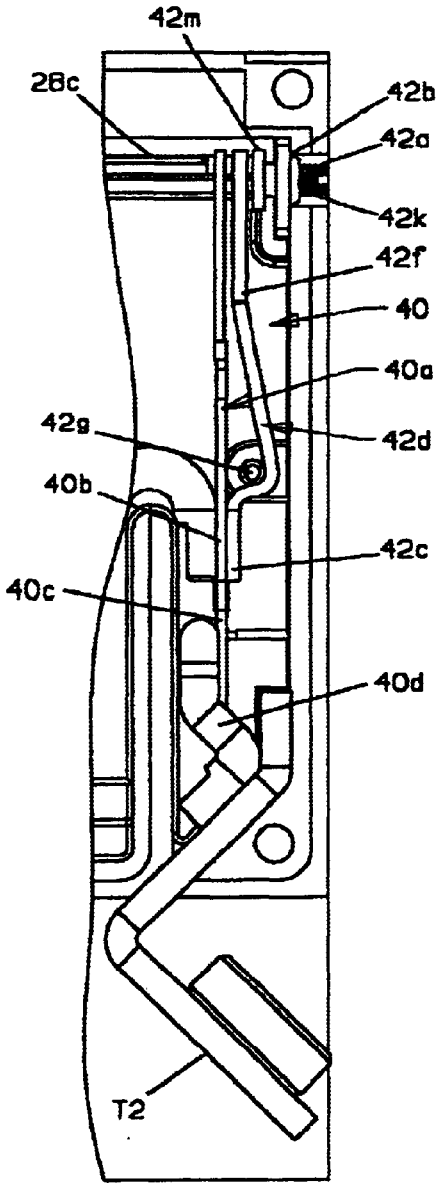
FIG. 4 is a broken away front elevational view of the actuator and calibration assemblies made according to a first preferred embodiment of the invention.
Figure 4A:
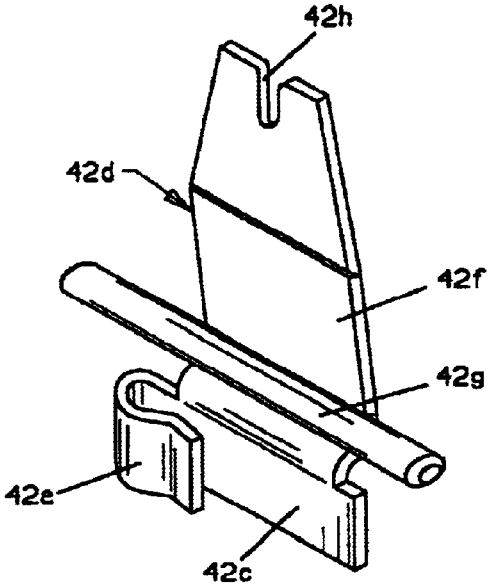
FIG. 4*a* is a perspective view of the calibration base of the FIG. 4 structure.
Figure 5:
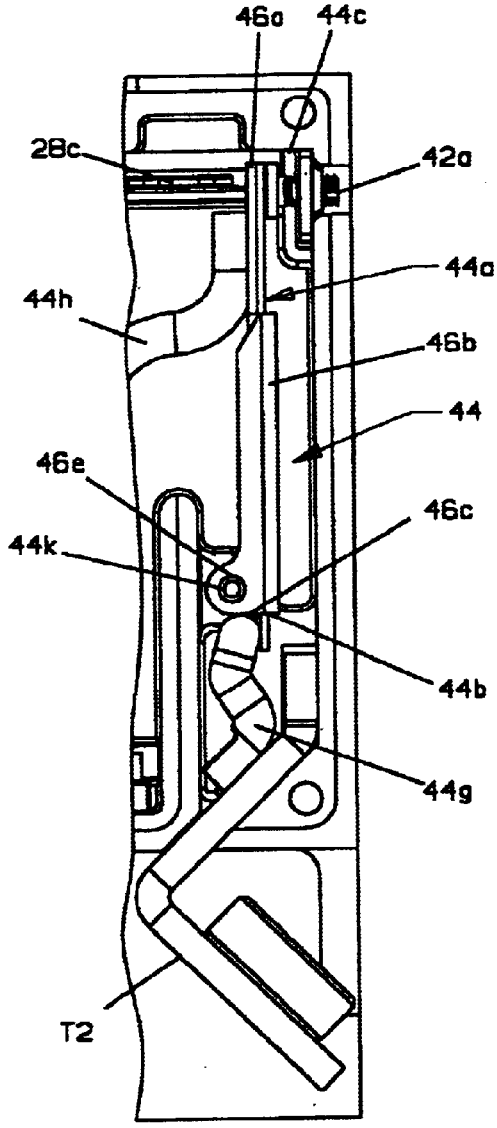
FIG. 5 is a front elevational view of the actuator and calibration assemblies made according to a second preferred embodiment of the invention.
Figure 5A:
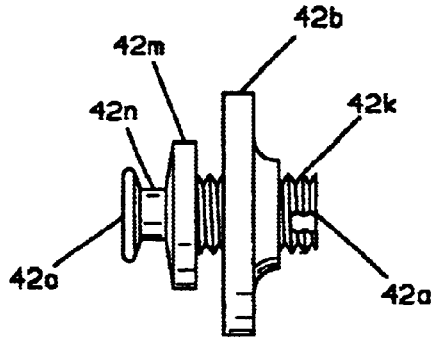
FIG. 5*a* is a front view of the calibration screw and calibration screw plate of the FIG. 5 structure.
Figure 5B:
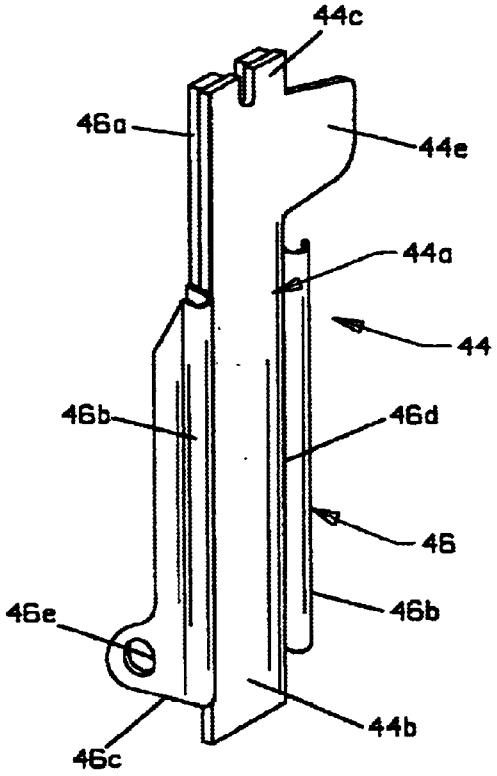
FIG. 5*b* is a perspective elevational view of a portion of the FIG. 5 actuator assembly in the at rest ambient temperature condition.
Figure 5C:
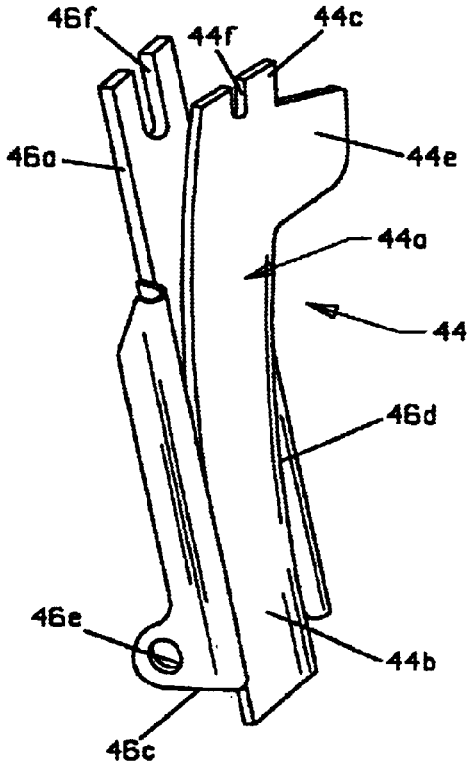
FIG. 5*c* is a view similar to FIG. 5*b* of the actuator assembly when the trip arm is in the heated condition.

With reference to FIG. 4, an actuator assembly 40 and associated calibration structure made in accordance with a first preferred embodiment of the invention comprises a calibration screw 42*a* received in a threaded bore of a calibration screw plate 42*b* mounted in the circuit breaker housing so that the longitudinal axis of the screw is essentially in line with motion transfer member 28*c*.

As in the prior art circuit breaker discussed above, the actuator arm 40*a* is a generally U-shaped bimetallic member. However, as shown in FIG. 4, the free end of one leg 40*b* is fixedly and electrically connected, as by welding, to a first portion 42*c* of a pivotably mounted calibration base 42*d*. First portion 42*c* has a transversely extending tab 42*e* which is bent back over first portion 42*c* to form a clip. The free end of the second leg 40*c* extends beyond that of leg 40*b* with the free end electrically connected, as by welding, to a flexible conductor, such as a first pigtail 40*d* which in turn is connected to load terminal T2. The remainder of leg 40*c* is covered with insulating tape, such as Kapton tape, and is captured in the clip formed by tab 42*e*. The first portion 42*c* of calibration base 42*d* has a second flexible conductor or pigtail 40*e* electrically connected thereto, as by welding, with the opposite pigtail end leading to the contacts as in the FIGS. 1, 2 circuit breaker.

Calibration base 42*d* has a second elongated portion 42*f* extending from first portion 42*c* with a transversely extending pin 42*g* intermediate to the first and second portions. Second portion 42*f* is generally coextensive with and preferably slightly spaced from actuator arm 40*a*. Pin 42*g* is received in recessed seats formed in the case halves for pivotably mounting actuator assembly 40 with second portion 42*f* moving toward and away from motion transfer member 28*c*. The free distal end of second portion 42*f* is formed with a longitudinally extending slot 42*h*. Calibration screw 42*a* is formed with a slotted end 42*k* at one end and a head 42*m* at its opposite end. A circumferential groove 42*n* is formed in head 42*m* which is received in slot 42*h* of the calibration base. Rotation of calibration screw 42*a* will transfer motion at a 1:1ratio to actuator assembly 40 either toward or away from motion transfer member 28*c*.

Upon application of power, current flows through the load terminal T2 to the first pigtail 40*d*, through trip arm 40*a*, second pigtail 40*e* to the contacts. The trip arm heats and bends in the same manner as in the FIGS. 1, 2 structure, providing the mechanical deflection to trip the circuit breaker upon an overload.

FIGS. 5 and 5*a* –5*c* show an actuator assembly 44 and associated calibration structure according to a second preferred embodiment of the invention. Actuator arm 44*a* in this embodiment is a straight length of thermostatic material connected to a calibration base 46, as by welding, adjacent a first end 44*b*. Calibration base 46 has a straight length portion having a width generally corresponding to that of trip arm 44*a* and extends to a second end 46*a* generally aligned with second end 44*c* of the trip arm. Calibration base 46 is preferably provided with sidewalls 46*b* along a portion of its length from first end 46*c* which strengthens the base avoiding any bending thereof. The sidewalls are preferably formed so that they extend slightly above the plane in which the surface which faces the trip arm lies forming an alignment guide 46*d* for receiving the trip arm therebetween. Aligned pin receiving apertures 46*e* are formed in sidewalls 46*b* adjacent first end 46*c*.

The second end of both calibration base 46 and trip arm 44*a* are formed with aligned longitudinally extending slots 46*f*, 44*f*, respectively. The width of slot 46*f* is selected to provide clearance for the outer or free end portion 42*o* of calibration screw 42*a* while the width of slot 44*f* is selected to be received in groove 42*n* of screw 42*a* capturing the trip arm between the opposed surfaces forming the groove.

A first flexible conductor, pigtail 44*g* is connected to the first end of trip arm 44*b*, as by welding, and to load terminal T2. A second flexible conductor, pigtail 44*h* is similarly connected to the second end of trip arm 44*a* at a transversely extending tab portion 44*e* extending from the trip arm. The actuator assembly 44 is pivotably mounted in the circuit breaker by pivot pin 44*k* extending between suitable pin receiving recesses formed in the case halves of the housing. Calibration screw 42*a* is mounted in calibration screw plate 42*b* as in the previous embodiment, aligned with motion transfer member 28*c* and with the second end of trip arm 44*a* captured in groove 42*n* of the calibration screw. Turning of calibration screw 42*a* will cause the actuator assembly to pivot toward or away from the motion transfer member at essentially a 1:1 ratio.

During operation, current flows through lead terminal T2 to first pigtail 44*g* and into the first end of trip arm 44*a*. The current then flows through second pigtail 44*h* to the contacts. With both ends of trip arm 44*a* supported, the trip arm bows as it is heated due to the different coefficients of expansion of its layers. Since the trip arm and calibration base are attached near the pivot location, the second end of the calibration base rotates towards the motion transfer member 28*c* with the change in slope of the bowing trip arm, see FIG. 5*c*.

As noted above, the invention results in reduced sensitivity to calibration, avoiding the amplified displacements of conventional designs. This enhances performance repeatability, lowers manufacturing costs and improves product yields.

Another benefit provided by the invention is that the arrangement avoids the stress levels relied in the prior art discussed previously in which stress relieving of the calibration base and trip arm can occur; thus, changing the calibration of the circuit breaker.

Yet another benefit is provided by placing the calibration screw in line with the motion transfer member. Since the circumferential groove in the calibration screw is typically somewhat larger than the thickness of the material it captures, a certain amount of play of the calibration base of the prior art design occurs which results in amplified motion of the trip arm and can cause calibration shifts and reduce repeatability. Although the same play can occur in calibration assemblies of the invention, this play is not amplified so that the invention reduces overall calibration shift and enhances device repeatability.

It should be understood that although particular embodiments of the invention have been described by way of illustrating the invention, other embodiments and variations are possible. It is intended that the invention include all modifications and equivalents of the disclosed embodiments within the scope of the claims.

What is claimed:

1. A circuit breaker comprising a housing, a stationary electrical contact mounted in the housing, a movable contact assembly having a movable electrical contact movable between open and closed contacts positions with the stationary electrical contact, a spring member for applying a contacts opening force to the movable electrical contact, a latching mechanism for maintaining the movable electrical contact in the closed contacts position, a motion transfer member for transferring motion to the latching mechanism to unlatch the movable electrical contact and allow the movable electrical contact to move to the contacts open position under the influence of the contacts opening force, an actuator assembly pivotably mounted in the housing, the actuator assembly comprising an elongated bimetallic trip arm and a calibration base each having first and second ends, the first end of the trip arm fixedly attached to the first end of the calibration base, a calibration screw mounted in the housing generally in alignment with the motion transfer member, the calibration screw having a head in engagement with the actuator assembly and, upon rotation of the calibration screw, being movable toward and away from the motion transfer member to pivot the actuator assembly to a selected position relative to the motion transfer member, current carrying flexible members electrically connected to spaced apart portions of the bimetallic trip arm forming part of a current path in the circuit breaker, the bimetallic trip arm being deflectable upon a selected overload so that a portion of the overload trip assembly moves and transfers motion through the motion transfer member to unlatch the latching mechanism allowing the contacts opening force to move the movable electrical contact to the open contacts position.

2. A circuit breaker according to claim 1 in which the head of the calibration screw is in engagement with the calibration base.

3. A circuit breaker according to claim 2 in which the bimetallic trip arm is generally U-shaped having first and second legs joined by a bight portion, the free ends of the legs forming the first end of the trip arm and the bight forming the second end of the trip arm.

4. A circuit breaker according to claim 3 in which a slot is formed in the second end of the calibration base and the calibration screw has a head formed with a circumferentially extending groove which is received in the slot of the calibration base.

5. A circuit breaker according to claim 3 in which the first end of the calibration base is welded to the free end of one leg of the bimetallic trip arm and the first end of the calibration base is formed with a transversely, outwardly extending tab which is bent back over itself forming a clip and the other leg of the bimetallic trip arm is provided with a layer of electrically insulating material and a portion of the other leg is captured and held by the clip.

6. A circuit breaker according to claim 1 in which the head of the calibration screw is in engagement with the bimetallic trip arm.

7. A circuit breaker according to claim 6 in which the bimetallic trip arm extends along a straight line.

8. A circuit breaker according to claim 7 in which a slot is formed in the second end of the bimetallic trip arm and the calibration screw has a head formed with a circumferentially extending groove which is received in the slot of the bimetallic trip arm.

9. A circuit breaker according to claim 8 in which the calibration base is formed with a flat elongated surface having a width selected to accommodate the bimetallic trip arm, the calibration base having opposed sidewalls which receive the bimetallic trip arm closed therebetween.

10. A circuit breaker comprising a housing, at least one stationary electrical contact mounted in the housing, a movable contact assembly having at least one movable electrical contact movable between open and closed contacts positions with the at least one stationary electrical contact, a latching mechanism for maintaining the at least one movable electrical contact in the closed contacts position during normal operation, a motion transfer member for transferring motion to the latching mechanism to unlatch the at least one movable electrical contact and allow the at least one movable electrical contact to move to the open contacts position, a generally U-shaped current carrying trip arm having first and second legs joined at a bight, the bight aligned with and deflectable into engagement with the motion transfer plate, the first and second legs having free ends, a calibration base pivotably mounted in the housing, the base having first and second portions, the free ends of the first and second legs fixed to the first portion of the calibration base, the second portion of the calibration base aligned with the bight of the trip arm and a calibration screw mounted in the housing generally aligned with the motion transfer member having a head portion engageable with the second portion of the calibration base to rotate the base and concomitantly the trip arm toward the motion transfer member, the trip arm being electrically connected to a circuit path of the circuit breaker, the bight of the trip arm deflecting toward the motion transfer member upon sufficient $I^2$ R heating thereof, to move the motion transfer member and trip the circuit breaker.

11. A circuit breaker according to claim 10 in which the first portion of the calibration base captures a leg of the trip arm adjacent the free end thereof but is electrically isolated therefrom and the free end of the other leg is welded to the first portion of the calibration base.

12. A circuit breaker comprising a housing, at least one stationary electrical contact mounting in the housing, a movable contact assembly having at least one movable electrical contact movable between open and closed contacts position with the at least one stationary electrical contact, a latching mechanism for maintaining the at least one movable electrical contact in the closed contacts position during normal operation, a motion transfer member for transferring motion to the latching mechanism to unlatch the at least one movable electrical contact and allow the at least one movable electrical contact to move to the open contacts position, a generally straight bimetallic trip arm having first and second ends, a calibration base pivotably mounted in the housing and having first and second ends, the calibration base having a flat straight surface receiving thereon the bimetallic trip arm with the first end of the calibration base welded to the first end of the bimetallic trip arm, the second ends of the calibration base and the bimetallic trip arm generally coextensive and aligned with and movable toward and away from the motion transfer member, the calibration base disposed between the bimetallic trip arm and the motion transfer member and a calibration screw mounted in the housing and formed with a head connected to the second end of the bimetallic trip arm and being rotatable to move the bimetallic trip arm and concomitantly the calibration base toward and away from the motion transfer member, the bimetallic trip arm being connected in a circuit path of the circuit breaker with the bimetallic trip arm upon sufficient $I^2$ R heating forming a bowing configuration extending in a direction toward the motion transfer member causing the calibration base to pivot with the second end thereof transferring motion to the motion transfer member to trip the circuit breaker.

* * * * *